United States Patent [19]

Häusler et al.

[11] Patent Number: 4,613,088

[45] Date of Patent: Sep. 23, 1986

[54] ARRANGEMENT FOR REINFORCING AND SPACING ANNULAR DISKS OF A HAMMER ROTOR

[75] Inventors: Dietrich Häusler, Vellmar; Horst Schwarz, Söhrewald, both of Fed. Rep. of Germany

[73] Assignee: Thyssen Industrie Aktiengesellschaft, Essen, Fed. Rep. of Germany

[21] Appl. No.: 629,633

[22] Filed: Jul. 11, 1984

[30] Foreign Application Priority Data

Jul. 28, 1983 [DE] Fed. Rep. of Germany ..... 3327204

[51] Int. Cl.[4] ..... B02C 13/00

[52] U.S. Cl. ..... 241/197; 241/194

[58] Field of Search ..... 173/94, 99, 101; 241/197, 196, 194, 193

[56] References Cited

U.S. PATENT DOCUMENTS

| | | | |
|---|---|---|---|
| 4,056,232 | 11/1977 | Linnerz et al. | 241/194 |
| 4,313,575 | 2/1982 | Stepanek | 241/197 |
| 4,406,415 | 9/1983 | Greer | 241/197 |

*Primary Examiner*—Donald R. Schran
*Assistant Examiner*—James R. Wolfe
*Attorney, Agent, or Firm*—Becker & Becker, Inc.

[57] ABSTRACT

An arrangement for reinforcing and spacing annular hammer rotor disks which are securely mounted on a rotor shaft. Disposed between these disks, there are provided pivotable, replaceably mounted hammers which are offset over the periphery of the rotor and are disposed at a distance from one another. The hammers located close to one another in a row are mounted on a common supporting rod which is parallel to the axis of rotation. A plurality of U-shaped replaceable strips, each of which is provided with a crosspiece, can be placed and secured on one of the annular disks in the circumferential direction thereof. The crosspiece of one strip rests against the crosspiece of the adjacent strip, and the intersection of the abutting ends of two strips is disposed in a radial plane of one of the supporting rods. Each crosspiece, at least on a long side and near an end, is provided with a cutout which corresponds approximately to the radius of pivot and thereof approximately to half the width of the hammer.

1 Claim, 3 Drawing Figures

ARRANGEMENT FOR REINFORCING AND SPACING ANNULAR DISKS OF A HAMMER ROTOR

BACKGROUND OF THE INVENTION

1. Field of the Invention

The present invention relates to an arrangement for reinforcing and spacing annular hammer rotor disks which are fixedly mounted on a rotor shaft. Disposed between the annular disks, there are provided pivotable, replaceably mounted hammers which are offset over the periphery of the rotor and spaced at a distance from one another. Hammers located close to one another in a row are mounted on a common supporting rod which is parallel to the axis of rotation.

2. Description of the Prior Art

With one heretofore known hammer rotor of this general type, spacers are arranged in the free spaces between two adjacent annular disks where no hammer is disposed on the supporting rod; the spacers are secured simultaneously with the hammer supporting rod. A drawback to this is that when a worn hammer is replaced, at the same time a number of spacers on the supporting rod are also released. During installation, in addition to the hammers, the released spacers also must be replaced on the supporting rod. Due to the simultaneous placement of the hammers and the spacers on a common supporting rod, not only installation into the rotor but also dismantling from the rotor is very complex and time consuming.

An object of the present invention is to provide an arrangement of the aforementioned general type which permits a rapid and easy replacement of those hammers disposed in a row on a given supporting rod independently of the spacers.

BRIEF DESCRIPTION OF THE DRAWINGS

This object, and other objects and advantages of the present invention will appear more clearly from the following specification in conjunction with the accompanying drawings, in which.

SUMMARY OF THE INVENTION

The arrangement of the present invention is characterized primarily in that a plurality of U-shaped, replaceable strips, each of which has a crosspiece, can be placed and secured on each annular disk, in the circumferential direction thereof; the crosspiece of one strip rests against the crosspiece of the adjacent strip or strips, and the intersection of the abutting ends of two strips is located in the radial plane of one of said supporting rods; furthermore, each crosspiece, at least on one long side and in the vicinity of the end thereof, is provided with a cutout which corresponds approximately to the radius of pivot and approximately to half of the width of the hammer.

The advantages achieved with the present invention are based primarily on the fact that now thinner annular disks can be used. Furthermore, with the inventive arrangement for reinforcing and spacing, the supporting rods with the hammers mounted thereon, as well as the mounting rods with their associated U-shaped strips, each can be individually replaced in a simple and rapid manner without having to disturb the adjacent U-shaped strips or hammers.

Pursuant to further advantageous features of the present invention, the prong-like legs of each U-shaped strip, which extend over both sides of a given annular disk, are provided each having therein a hole disposed transverse to the plane of the annular disk; a given mounting rod extends through this hole and in turn can be fixed in holes of the annular disks. Each mounting rod for the U-shaped strips also can be parallel to the axis of rotation, can be disposed on a circle which is concentric to the circle of the hammer supporting rods which are parallel to the axis of rotation, and can be disposed on the angle bisector of an angle formed by two adjacent hammer supporting rods, with the center of the rotor shaft being the apex.

DESCRIPTION OF PREFERRED EMBODIMENTS

Figure 1:
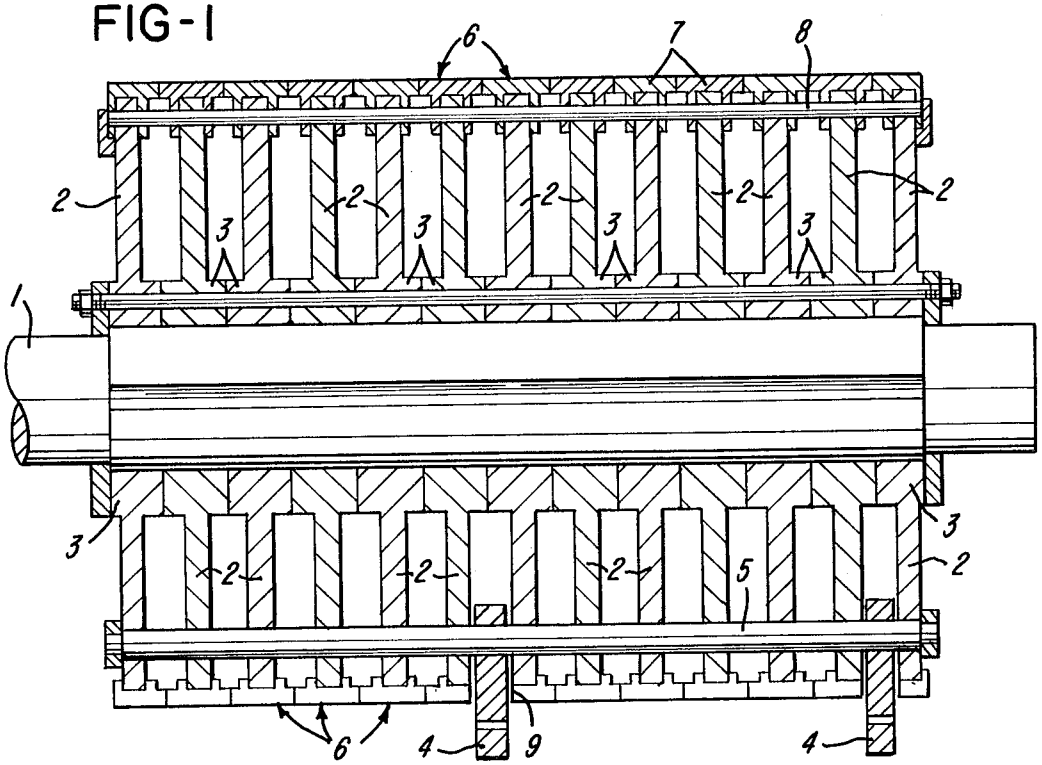
FIG. 1 is a longitudinal cross-section view taken along the line I—I in FIG. 2 through a hammer rotor having one embodiment of the inventive arrangement for reinforcing and spacing annular disks.
Figure 2:
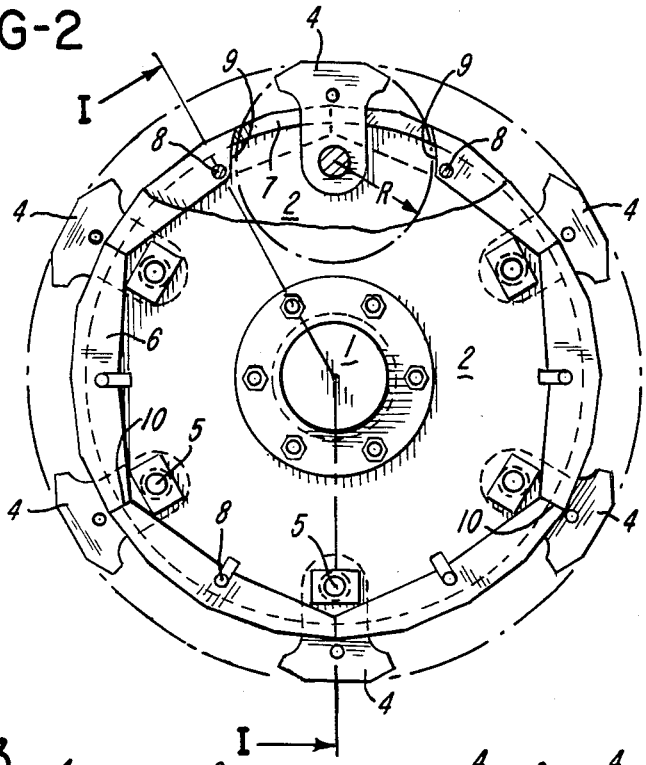
FIG. 2 is an end view of the hammer rotor of FIG. 1, with the front annular disk being partially broken away.
Figure 3:
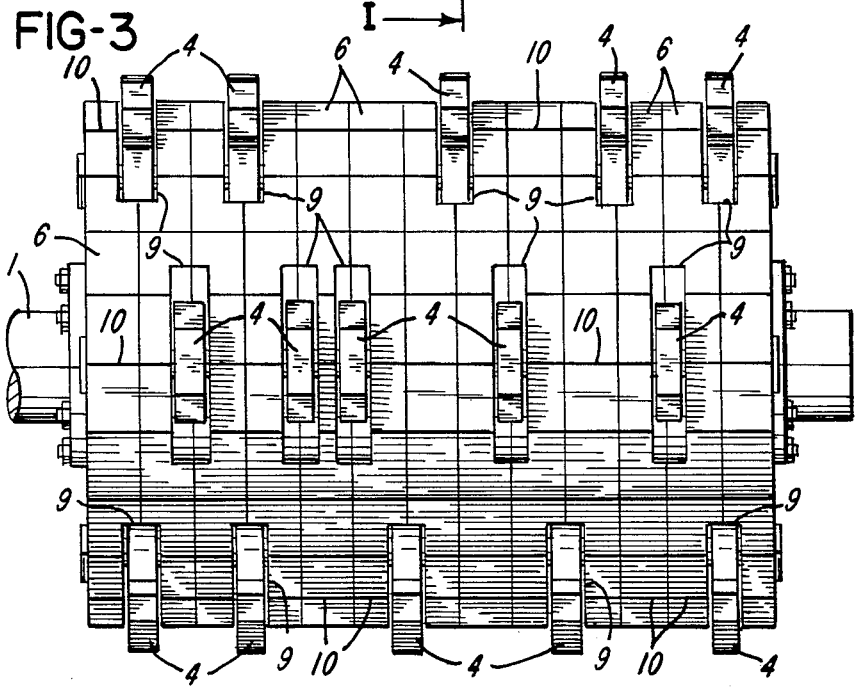
FIG. 3 is a plan view of the disposition of strips which can be placed on the annular disks and are arranged in rows next to and after one another.

Referring now to the drawings in detail, the hammer rotor shown in FIGS. 1 and 2 essentially comprises a rotor shaft 1, and a plurality of annular disks 2 which are disposed radial to the rotor shaft 1. The hub 3 of each disk 2 extends beyond the width of the disk and is fixedly secured to the shaft 1. All of the hubs 3 of the disks 2 are positively connected with one another by known securing means which concentrically extend through the hubs. Disposed between each two annular disks 2, there are hammers 4 which are provided distributed over the periphery of the rotor and are offset relative to one another. The hammers 4 are pivotably mounted on supporting rods 5 which are disposed parallel to the rotor shaft 1 and extend through the annular disks 2. Each hammer supporting rod 5 is secured against axial movement by known elements which are disposed at the outer sides of the two outer annular disks 2. All hammers 4 located close to one another in a row are pivoted in common on the same supporting rod 5. As can be seen from FIG. 2, all of the supporting rods 5 are disposed concentric relative to the rotor shaft 1, and at uniform distances on a circle.

For purposes of reinforcement and spacing, a plurality of replaceable strips 6 are placed on each annular disk 2 over the periphery thereof. Each strip 6 has a U-shaped cross section, as well as a crosspiece 7. Each strip 6 positively engages the corresponding strip on the adjacent annular disk 2. Each U-shaped strip 6 extends over an annular disk on both sides by means of prong-like legs, in which are located holes for mounting them to the annular disks. The U-shaped strips, which are placed in a row next to one another on the annular disks, are secured by mounting rods 8 which extend through aligned through-bores of the annular disks. An axial movement of the mounting rods 8 is again precluded by means of securing elements on the outer sides of the two outer annular disks. The mounting rods 8, which also are disposed parallel to the axis of rotation, are located on a circle which is concentric to the circle of the hammer supporting rods. Each mounting rod 8 is disposed centrally between an angle formed of two supporting rods 5 arranged one after the other in the direction of rotation of the rotor, with the center of the rotor shaft 1 being the apex.

Each U-shaped strip 6 is provided with at least one cutout 9, which is located in the long side and in the end of the strip 6. This cutout 9 has a length which corresponds approximately to the radius of pivot R of the hammer 4, which can be pivoted by 360°, and a width which corresponds approximately to half of the width of the hammer.

Each intersection 10 of the ends of the U-shaped strips 6, which abut one another positively, is disposed in the radial plane of a hammer supporting rod 5, and extends in the axial direction.

The surface of the U-shaped strips 6, which comprises wear-resistant material, can be flat or polygonal.

The present invention is, of course, in no way restricted to the specific disclosure of the specification and drawings, but also encompasses any modifications within the scope of the appended claims.

What we claim is:

1. In an arrangement for reinforcing and spacing annular disks of a hammer rotor, said disks being fixedly mounted on a rotor shaft having an axis of rotation; pivotable hammers being disposed between various ones of said annular disks in such a way as to be offset over the periphery of said rotor, and in such a way as to be spaced from one another; those hammers located in a row when viewed in the axial direction of said rotor shaft being replaceably mounted on a common supporting rod so that all hammers located close to one another in a row are pivoted in common on the same supporting rod; several such supporting rods being provided angularly spaced from each other, each being parallel to said axis of rotation; the improvement in combination therewith comprising:

a plurality of replaceable, U-shaped strips placed on each annular disk in the circumferential direction thereof for reinforcing and spacing therewith so that thinner disks can be used; means for mounting said U-shaped strips structurally separate from said hammers; each of said strips having a crosspiece, two long sides, and two ends; the crosspiece of a strip on a given annular disk rests against the crosspiece or crosspieces of the adjacent strip or strips of other annular disks; on a given annular disk, each intersection of abutting ends of two strips which abut one another positively being located in a radial plane in which is also located one of said supporting rods for said hammers and extends in axial direction; each of said crosspieces of each of said strips, on at least one of said long sides thereof, and near at least one of said ends thereof, being provided with at least one cutout, the dimensions of which correspond approximately to the radius of pivot of said hammers which can be pivoted by 360°, and approximately to half the width of said hammers; each of said strips including prong-like legs which are connected to said crosspiece and extend over both sides of a given annular disk; each of said legs having a hole which extends transverse to the plane of the associated annular disk; each of said annular disks being provided with corresponding holes; and including, for each row of strips, when viewed in the axial direction of said rotor shaft, a mounting rod which extends through said holes of said legs and through holes of said annular disks to secure said strips to said disks so that with the arrangement for reinforcing and spacing, the supporting rods with the hammers mounted thereon, as well as the mounting rods with the U-shaped strips associated therewith, each can be replaced individually in a simple and rapid manner without having to disturb any adjacent U-shaped strips and hammers; said supporting rods for said hammers being disposed on an imaginary circle which is concentric to said rotor shaft; said mounting rods for said strips each being parallel to said axis of rotation of said rotor shaft and being disposed on an imaginary circle which is concentric to said circle of said supporting rods arranged one after the other in the direction of rotation of the rotor; and each of said mounting rods being disposed on a line which bisects the angle formed by two adjacent supporting rods, with the center of said rotor shaft being the apex of said angle.

* * * * *